United States Patent [19]

Ishizuka

[11] 4,334,975

[45] Jun. 15, 1982

[54] APPARATUS FOR ELECTROLYTIC PRODUCTION OF MAGNESIUM METAL FROM ITS CHLORIDE

[76] Inventor: Hiroshi Ishizuka, 19-2, Ebara 6-chome, Shinagawa-ku, Tokyo, Japan

[21] Appl. No.: 188,589

[22] Filed: Sep. 18, 1980

[30] Foreign Application Priority Data

| | | | |
|---|---|---|---|
| Sep. 27, 1979 | [JP] | Japan | 54-124890 |
| Oct. 3, 1979 | [JP] | Japan | 54-127710 |
| Sep. 5, 1980 | [JP] | Japan | 55-123910 |

[51] Int. Cl.[3] ..... C25C 3/04; C25C 3/22; C25C 7/02

[52] U.S. Cl. ..... 204/247; 204/70; 204/268; 204/274; 204/288; 204/290 R; 204/293; 204/294

[58] Field of Search ..... 204/70, 243 R–247, 204/290 R, 294, 293, 274, 288, 268

[56] References Cited

U.S. PATENT DOCUMENTS

| | | | |
|---|---|---|---|
| 2,468,022 | 4/1949 | Blue et al. | 204/247 X |
| 2,629,688 | 2/1953 | Hunter et al. | 204/245 X |
| 2,785,121 | 3/1957 | Johnston | 204/247 |
| 3,396,094 | 8/1968 | Sivilotti et al. | 204/70 |
| 3,909,375 | 9/1975 | Holliday et al. | 204/70 X |
| 4,168,215 | 9/1979 | Kinosz et al. | 204/70 X |

*Primary Examiner*—Delbert E. Gantz
*Assistant Examiner*—Donald R. Valentine
*Attorney, Agent, or Firm*—Larson and Taylor

[57] ABSTRACT

The present invention provides an apparatus for electrolytic production of magnesium metal from its chloride, which apparatus essentially comprises at least one externally unwired electrode which is made of graphite alone or graphite-iron composite and is placed between each pair of anode and cathode with the graphite side towards the cathode. The apparatus preferably comprises further a cooling passage for electrolyte bath which allows the electrolyte bath to flow outside an electrolysis chamber where the electrodes are contained, from a bath surface level to the bottom. The bath, while it passes there, is cooled a little, not enough to solidify, to exhibit an increased density so that it flows down back into the electrolysis chamber at the bottom, thus forming a continuous upflow along the electrodes, which facilitates separation of products of magnesium metal and chlorine gas and their recovery. Preferred anode construction is also illustrated.

16 Claims, 13 Drawing Figures

APPARATUS FOR ELECTROLYTIC PRODUCTION OF MAGNESIUM METAL FROM ITS CHLORIDE

Figure 1:
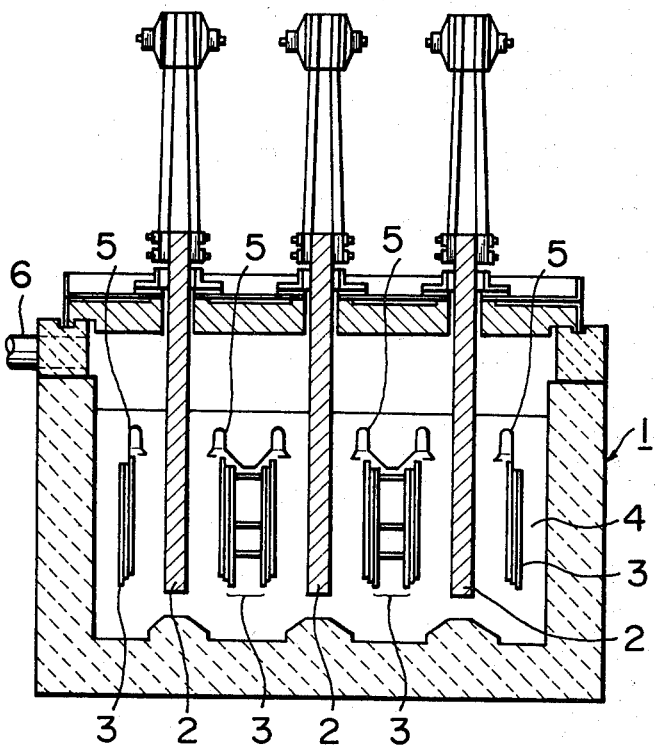

The present invention relates to an apparatus for electrolytic production, particularly, of magnesium metal from its chloride.

In production of magnesium metal on an industrial scale electrolytic cells developed by the I. G. Farben combine (Germany) or Aluminum Company of Canada (Canada) have conventionally been employed. The cells essentially use an arrangement of simple electrode pair consisting of just one graphite anode and two iron cathods, such pairs being combined electrically power supplied in parallel. That technique inevitably involves a rather large loss in voltage and heat through a number of anodes and cathodes employed and wiring leads connected thereto, so that a considerable amount of energy, principally in electricity, is needed in excess just for making up for such loss, causing a wasteful energy consumption where any electrolytic reaction is substantially not related.

An electrolytic apparatus of horizontal multi-cellular type has recently been developed with an intention of attaining a considerable reduction of energy consumption. Since the apparatus is of a design especially for production of aluminum metal from the chloride bath, this is ineffective to magnesium production due mainly to its relative property to the bath contrary to the case of aluminum. In electrolytic run with chloride bath, deposited aluminum metal, due to a density greater than the bath, will flow down in the latter, while the other product, chlorine gas, will move upwards, so that the metal product can readily be recovered as separated from the gas. In the case of magnesium electrolysis, in contrast, formed magnesium metal which exhibits a smaller density than the bath, will move upwards as well as the gas product. Thus if the above apparatus were applied to electrolysis of magnesium chloride, attainable economy in the metal production should be very poor because deposited magnesium and chlorine readily combine together in the bath back into the chloride and, in addition, electric current tends to leak through the metal product to some degree.

Therefore the principal object of the present invention is to provide an apparatus for electrolysis of magnesium chloride, which apparatus is substantially free of the above mentioned drawbacks and which achieves considerable improvement in both productivity and power efficiency.

According to the invention the apparatus for electrolytic production of magnesium metal from its chloride essentially comprises:

(1) a closed electrolysis chamber which is capable of holding in fused state a bath material substantially consisting of magnesium chloride;

(2) at least a pair of anode and cathode placed substantially vertically and contained in the electrolysis chamber with one respective end outside for electrical connection;

(3) means for individually recovering products of magnesium metal and chlorine gas; and characteristically (4) at least one externally unwired intermediate electrodes placed between each pair of anode and cathode and arranged so that each pair of opposed major faces of electrodes have between them a space substantially in parallel or slightly tapered downwards, said intermediate electrodes respectively consisting substantially of graphite or graphite-iron composite with the graphite-side towards anode.

The invention as featured above can be realized in various ways. For example the electrolysis chamber is usually made of an electrically non-conductive refractory brick and closed with a detachable lid on the upper end.

The chamber preferably contains a platform which is made of a typical electrically non-conductive refractory material such as alumina, and which permits passage of downcoming sludge formed during electrolysis and upward movement of electrolyte bath introduced to the chamber at the bottom. For facilitation of removal of such sludge from the chamber, the latter preferably has an inclined floor towards one end thereof, and at the lower end of the chamber there is provided a means for discharging the sludge collected there. The electrolysis chamber is provided at the bottom with an inlet for fused magnesium chloride containing bath, and an outlet for chlorine gas product at an upper portion of wall above a bath surface level to be employed, as well as a channel means for magnesium metal product leading to a separate reservoir or else. The chamber can also be provided with an external passage for the electrolyte bath with an outlet at the bath level and an inlet at the bottom, as detailed later. The chamber preferably has a row of recesses formed on the walls at either lateral end of each electrode to fitly accomodate the latter individually. This feature is effective for reducing leak of electric current and further advantageous especially when the external passage is employed.

In the electrolysis chamber there are contained an anode, at least one cathode and at least one intermediate electrode. They respectively are mounted on the platform which provides room for movement of bath and sludge. The anode and cathode, respectively, have one end outside the chamber for electrical connection, while the intermediate electrodes are not wired externally. These electrodes all are mounted on the platform directly or indirectly with an insertion of elongated block between them which is made of an electrically non-conductive refractory material such as alumina and extends along the electrodes. The block, which can be replaced by a projection of similar configuration unitarity formed with the platform, is effective to minimize current leak through the bath below the bottom of the electrodes.

An anode is made in thick plate of graphite with a substantially rectangular cross section. The material can be partially replaced by a metallic material such as nickel or nickel based alloy for improvement in conductivity and strength. A core portion of the anode can also be replaced by such metal if desired.

An anode is preferably provided with an electrically insulative block on the way to cover at least an area up from a level of a top of intermediate electrodes to the bath surface level in order to reduce current leak through the bath and metal product afloat on the surface. Such block, which is made of a typical insulating material like alumina, can be replaced by a plate, a partition or a coating applied to the anode.

Cathode is a plate typically made of iron and is arranged with a major face substantially vertical or slightly inclined. This electrode is placed at an end of the electrolysis chamber. The electrolysis chamber can contain one cathode against one anode, each at respective end of the chamber; alternatively two cathodes are used against one anode, with the former at each end and the latter at the middle.

The intermediate electrodes, which are characteristically employed in the invention can be made of graphite, but preferably are made of composite of a thinner iron plate jointed with a thicker graphite plate. They are arranged with the iron-side towards the anode, thus the iron serves as a cathode portion, while the graphite as an anode portion. For an improved prevention of current leak, one or more such electrodes can be provided with a current blocking piece of electrically insulative material on or in adjacence to either or each of the top and lateral edges of the major faces.

All the electrodes as mentioned above can be set with the major faces substantially vertical when they are placed wide apart from each other; while they preferably have such faces inclined a little against the verticality when the spacing between adjacent electrodes is rather small. Opposed faces of electrodes are set substantially in parallel or can be widened upwards for easier separation of chlorine gas from metal product, by ascending the gas along the electrode face. Such inclination is increased with decreased electrode spacing. With each voltage between the adjacent electrodes above the level to decompose magnesium chloride, that is, approximately 2.5 V, rise of number of electrodes increase possibility of current leak. The leakage is effectively prevented according to the invention with use of insulating material effectively provided to the electrodes at the bottom, better along with the top and/or lateral ends. Addition of above mentioned insulative block for the anode gives further improvement.

Electrodes in a preferred example are provided with a channel means at an upper portion. When the channel is for magnesium metal, it is formed as either a separate body or as a ditch on the electrode plate. Separate channel means is an elongated duct of open bottom closed top configuration and is placed at the top of electrode with the downward opening above the cathode side. A ditch on the electrode similarly has a downward opening to intercept magnesium product moving upwards along the electrode plate surface. The ditch has an ascent towards one end to collect and guide the metal outwards for a separate resevoir through another channel means connected with the one on the electrode. Such duct is placed at the top of the intermediate electrodes and cathode. Another channel means is provided for chlorine gas. In this case it can be either a duct similar in shape as above but much larger, or a partition extending across the electrolysis chamber with the lower end immersed in the bath. Such duct is attached to the anode as well as the anode side of each intermediate electrode.

An external cooling passage is advantageously added each of the above said electrolysis chamber arrangements. The passage is provided outside the electrolysis chamber just partitioned from the chamber and communicated in regard to bath flow at a level of bath surface and at the bottom with the electrolysis chamber. The passage can be formed in various ways such as separate pipes or like, but it is formed with a substantially rectangular section advantageously from the view point of overall economy. The function of the passage is that incoming electrolyte bath from the electrolysis chamber at a rather high temperature, while it passes there, is cooled, not enough to solidify, by radiation through rather thin wall or by cold air forcibly introduced on to such thin wall or in to the pipes placed in the passage. Thus getting cooler to show an increased density, the bath flows downwards until it enters back the electrolysis chamber at the bottom where the bath is heated electrically again to cause upward flow, thus forming a convectional circulation of electrolyte bath. This flow is preferred because the bath movement upwards facilitates removal of product, especially magnesium metal, from the electrode and helps to ascend in the bath.

Some preferred embodiments of the invention will be described in detail with reference to the accompanied drawings, in which FIG. 1 illustrates a cross section of a conventional apparatus employed for electrolysis of magnesium chloride which employs a plurality of simple electrode pairs consisting of an anode and two cathodes without any intermediate electrodes therebetween. Here an electrolysis chamber 1 constructed of refractory material contains anodes 2 of graphite and cathodes 3 of iron as opposed to either major face, and immersed in a bath 4 typically containing of 10–25% magnesium chloride and other ingredients such as sodium chloride and calcium chloride. The electrodes are placed with the distance of opposed faces at about 7.5 cm, and imposed potential of approximately 6 V. Magnesium product formed on the cathode, ascends in the bath, and is received in a duct 5 provided above the cathode and forwarded to outside the chamber for recovery, while the other product, chlorine gas is discharged through a port 6 on a wall of the chamber above the bath level.

Figure 2:
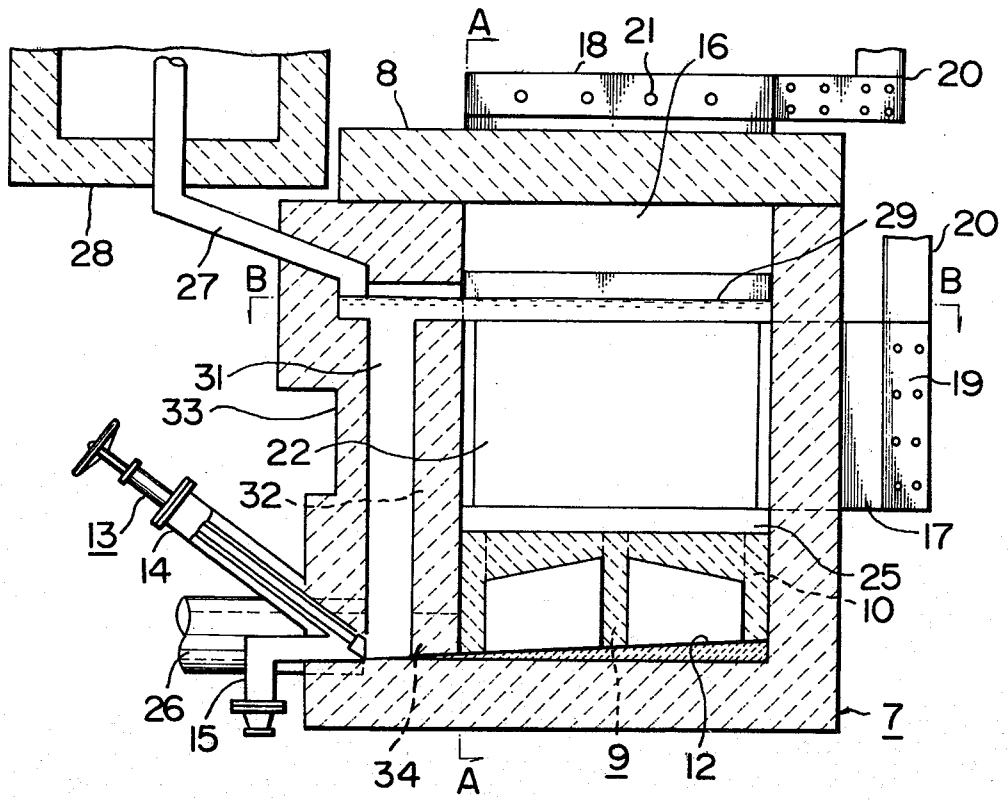
Figure 3:
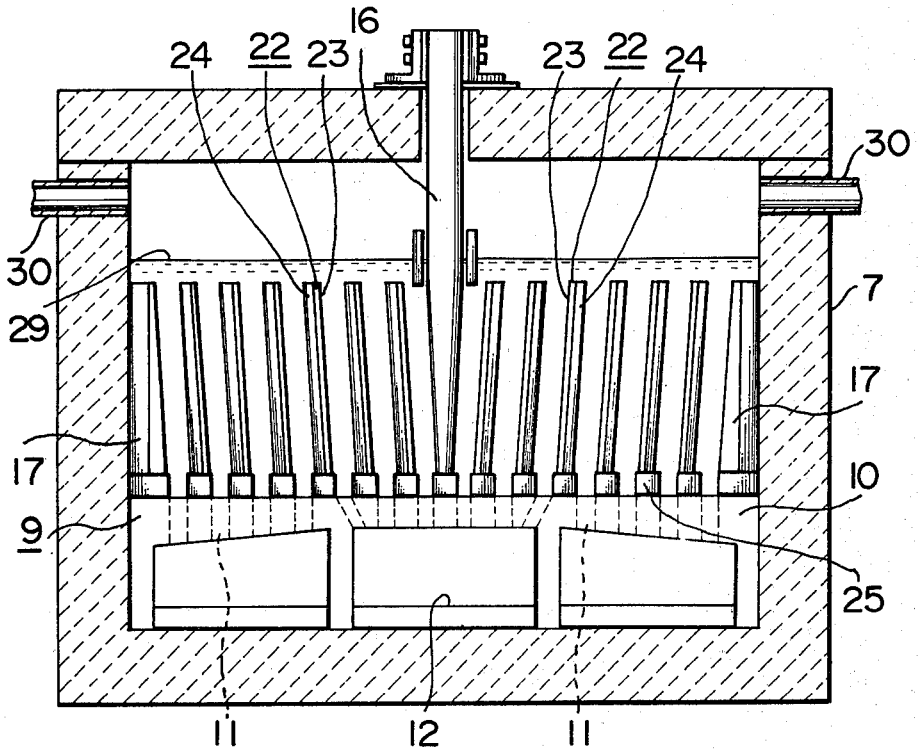
Figure 4:
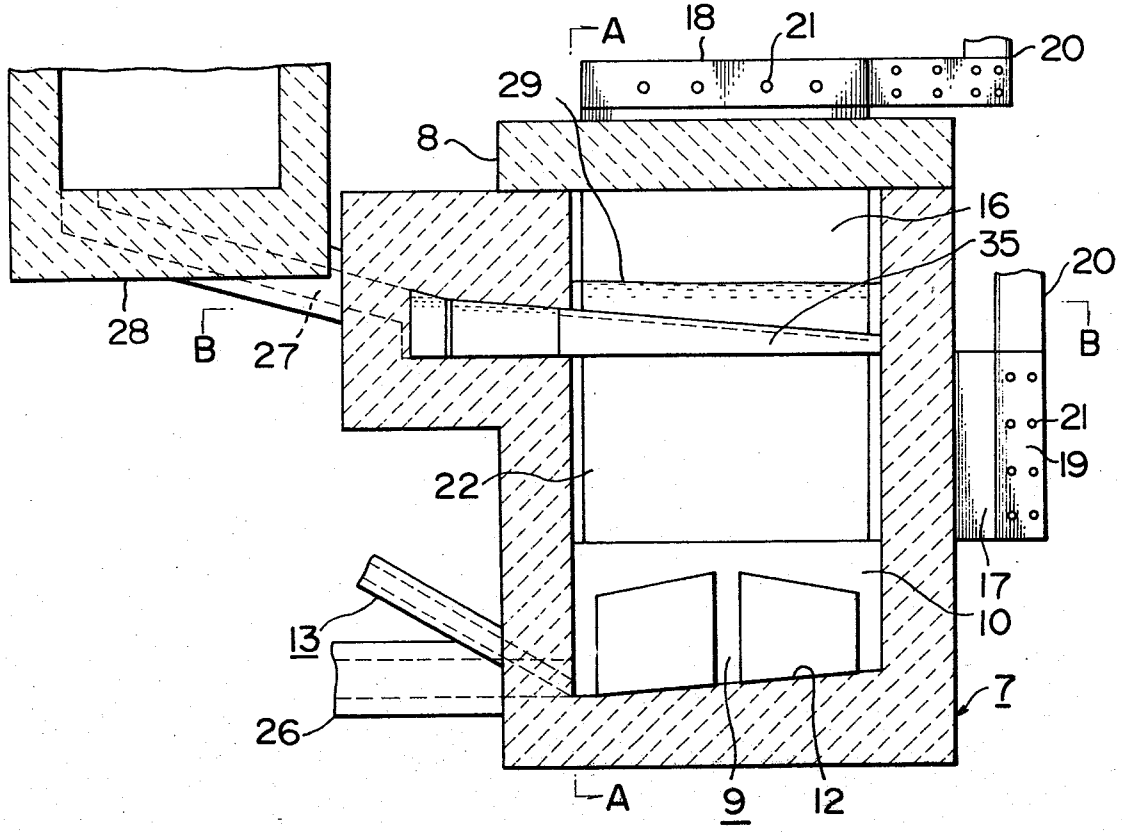
Figure 5:
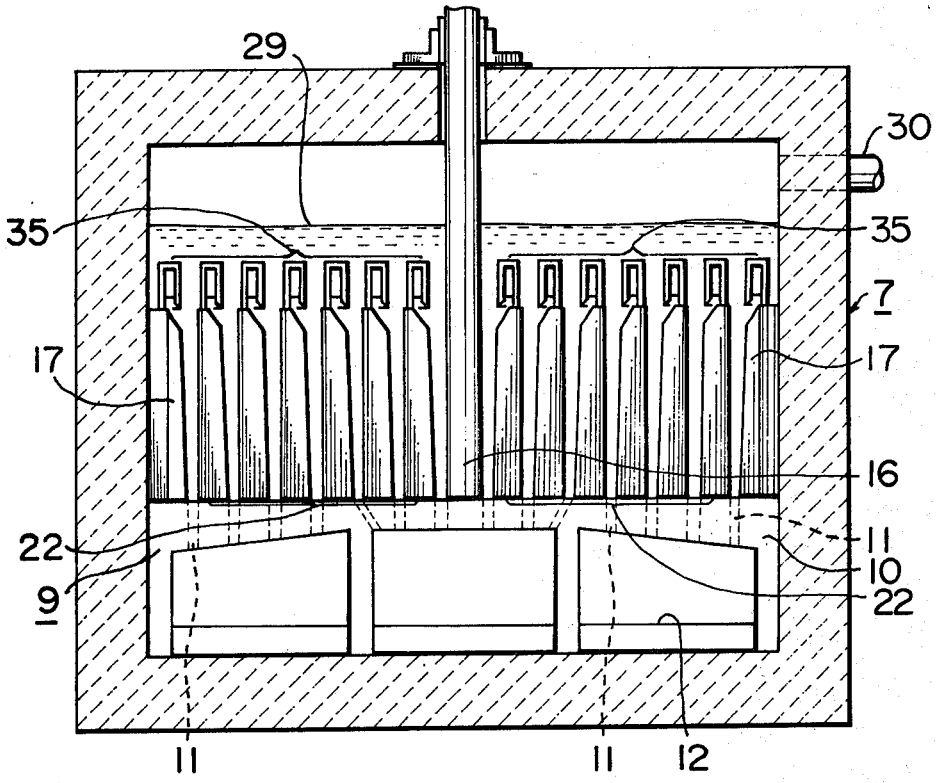
Figure 6:
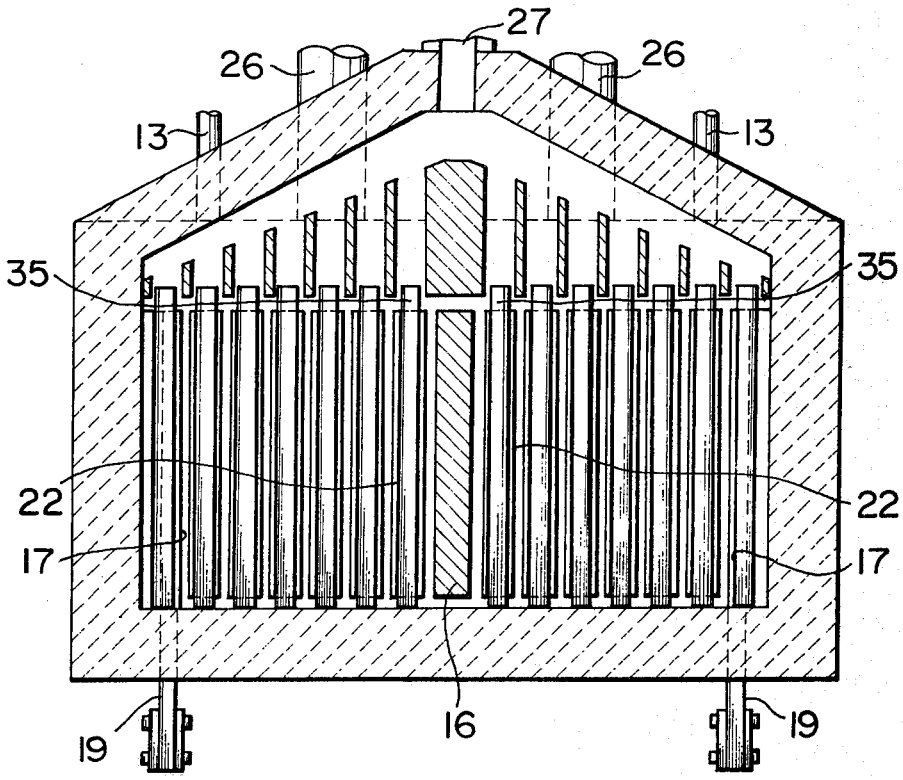
Figure 7:
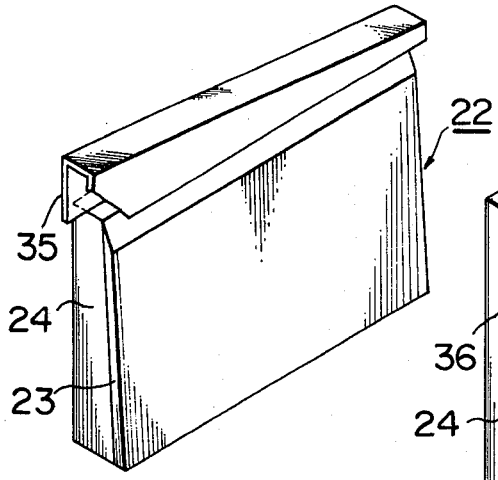
Figure 8:
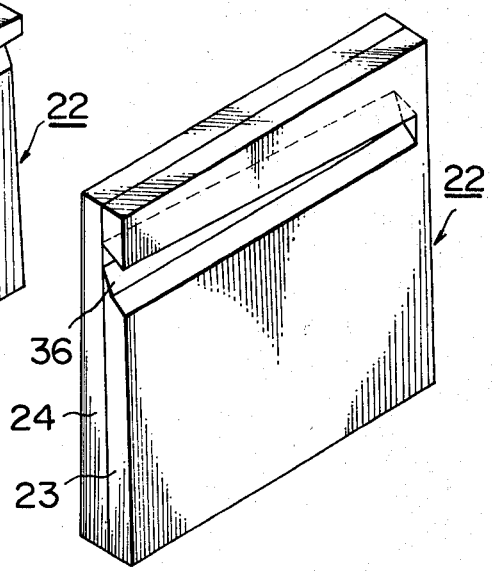
Figure 9:
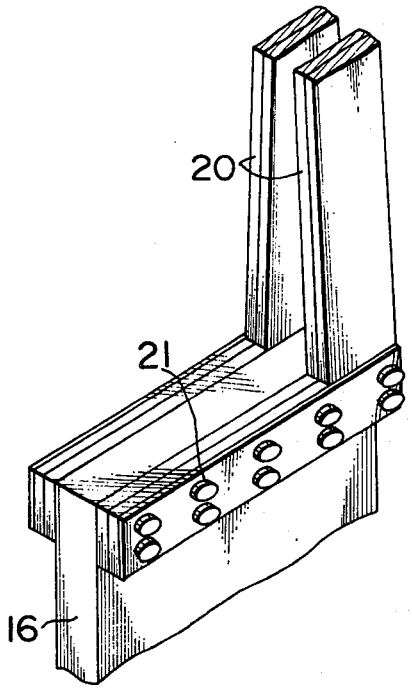

FIGS. 2 and 3 illustrate a preferred construction of apparatus according to the present invention, while FIGS. 4, 5 and 6 show another;

FIGS. 7 and 8 exemplify a few of channel means with an electrode applicable to the invention; and FIGS. 9, 10 A–B and 11 A–B show examples of anode configuration by outlook and section.

More particularly, FIGS. 2 and 4 are elevational sectional side view, and FIGS. 3 and 5 are sectional front view taken at A—A on FIGS. 2 and 4, respectively; FIG. 6, a horizontal sectional view taken at B—B on FIG. 4.

In these figures, an electrolysis chamber 7 is constructed of refractory brick and closed with a detachable lid 8 on an upper end thereof. The chamber contains a platform 9 which is made of alumina brick and has a lifted top 10 full of slits 11 for passage of the electrolyte bath and sludge. The floor 12 has an inclination towards one end for the purpose of easier collection of sluge where a discharging means 13 is reachable. Such means may comprise a valve 14 and pipe 15. An anode 16 of graphite is placed across the chamber 7 at the middle, while a cathode 17 of iron at each end on either side of the anode 16. The both electrode have an end 18, 19 outside the chamber for electrical connection. The anode 16 as conventionally has a terminal end as detailed in FIG. 9, in which metal bus-bar 20 are secured to the graphite anode 16 with bolting 21. Between the anode and each cathode there are placed six intermediate electrodes 22, respectively, which is a composite of smooth faced iron plate 23 jointed to graphite plate 24 with a substantially rectangular cross section. With an insulating block extending along at a close spacing on either side, the anode 16, as well as cathode 17 and intermediate electrodes 22, is placed over the platform 9 with an insertion of elongated block 25 of alumina extending along each electrode. A substantially equal spacing is given of about 5 cm between the opposed faces of adjacent electrodes of anode, cathode and intermediate electrodes. An electrolyte bath of fused chloride enters the electrolysis chamber through an inlet 26 at the bottom. For recovery of products a pipe means 27 leading to a separate reservoir 28 or else is provided for magnesium metal with a lower end of the pipe 27 below the bath surface level 29, while an outlet port 30 is positioned on end walls of the electrolysis chamber 7 for discharging chlorine gas above the bath surface level. In this example as illustrated particularly in FIG. 2, an additional passage 31 is provided outside the chamber, communicating the bath surface level with the bottom. The passage forms substantially a vertical shaft of a rectangular cross section and is separated from the chamber 7 by a partition 32 with an opening at both the top and bottom. The passage 31 has an outer wall 33 of a rather decreased thickness onto which cold air is forcibly introduced in some cases or a piping (not shown) within where cold air passes, so that incoming bath from the top of the chamber, while it passes this external passage 31, may be cooled a little, not enough to solidify, and flow down back into the electrolysis chamber 7 through a bottom opening 34 to complete a circulation.

In another example as illustrated particularly in FIGS. 4 to 6, an electrolysis chamber 7 is used of a similar construction to the first example except that the external passage for the bath is saved here. Instead a duct means 35 is provided atop the cathode 17 and each intermediate electrode 22. The duct 35 here is rectangular in cross section with an increasing area along the length, so that the duct 35 as placed in position may have a top ascending from one end to the other where another channel means is connected which extends towards a reservoir 28 for magnesium metal through a duct means 27. The duct means 35 atop the electrodes can be replaced by a ditch 36 formed on an iron plate of cathode 17 or on such 23 of composite intermediate electrodes 22 as detailed in FIG. 8.

Figure 10A:
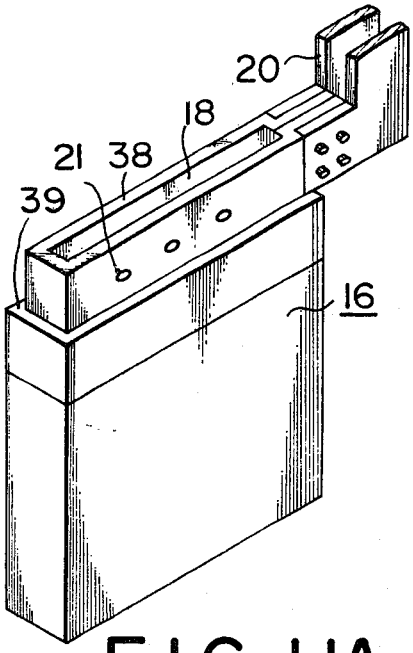
Figure 10B:
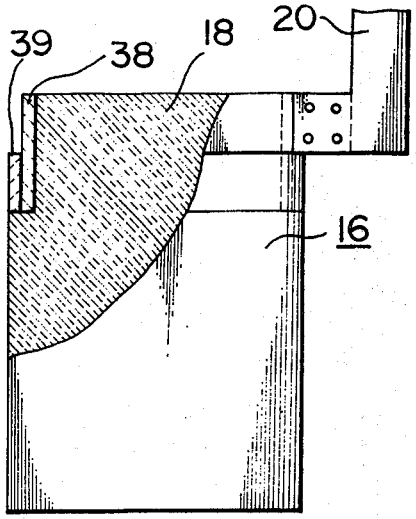

In some realization of the present invention an anode of graphite is replaced in part by a metallic material especially at an end placed outside the chamber for electrical connection. FIG. 10A shows an outlook of one example, while FIG. 10B shows a section thereof in part. The anode 16 illustrated here consists substantially graphite plate 37 with an upper portion of a reduced cross section. Such upper portion is covered with a metallic piece 38 worked to fit the portion, and the piece 38 in turn is overlaid with a square sleeve 39 of refractory material for protection of the metal against heat. A suitable material for the piece 38 and the sleeve 39 is for example nickel metal or nickel based alloy, and alumina, respectively. The metal piece is connected to wiring for power supply.

Figure 11A:
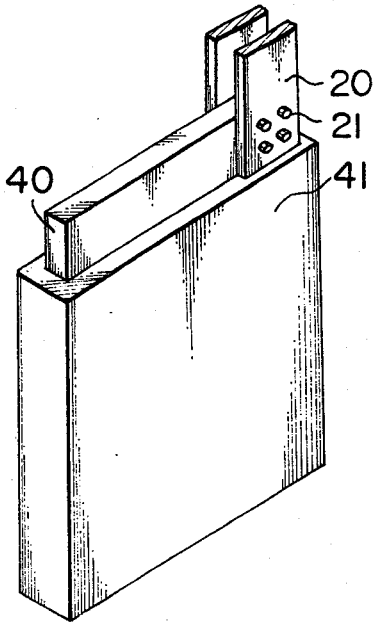
Figure 11B:
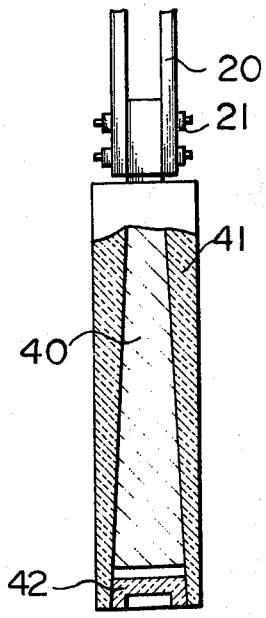

FIGS. 11A–B show another example in which a core portion of the electrode 16 is also replaced by a plate 40 of metallic material. A graphite shell 41 formed as a thick plate in appearance has a through cavity where a metallic plate is fitly accomodated. The metallic plate 40 projects through an opening at the upper end of the shell 41, while its portion within the shell is short of the lower end: a space at the bottom of the shell is closed with a plug means 42. For electrical supply a wiring bus-bar 20 is connected to the upper end of the metallic plate 40 projecting through the upper opening, secured with bolting.

Operation is exemplified with parameters using an apparatus of the present invention as illustrated in FIGS. 2 and 3. An electrolysis chamber is used which has inside dimensions of 1.2 m (width)×3.5 m (length)×1.8 m (height) with an external passage of 0.2 m (width)×3.5 m (length)×1.2 m (height) connected to the chamber at the top and bottom with openings. The passage substantially consists of a shaft of 0.2 m (width)×3.5 m (length)×1.2 m (height) separated from the electrolysis chamber with a partition, and connected thereto with openings at a height of 1.2 m and at the bottom. The bath in the passage is cooled by about 30° C. by radiation through a wall as thin as 23 cm, as compared with remaining portion at least 35 cm thick. In the electrolysis chamber there is placed a platform of alumina with a lifted top full of slits through the top. A graphite plate as anode of 1 m (width)×2 m (height)×10 cm (maximum width) is placed on the platform at the middle, while an iron plate of 1 m×0.8 m×5 cm (maximum thickness) is placed at either end of the chamber as cathode. Intermediate electrodes substantially consists of a composite of graphite plate of 1.0 m×0.8 m×10 cm (maximum width) and iron plate of 1.0 m×0.8 m×2 cm (thickness) secured together on one major face. Such intermediate electrodes are placed between the anode and each cathode, symmetrically six for each electrode pair, with a spacing of 4 cm at the lower end and 5 cm at the upper end. Fused electrolyte bath consisting of 20% magnesium, 30% calcium chloride and 50% sodium chloride is introduced to the chamber to fill up to 10 cm above the top of intermediate electrodes. Tension of 27 volts is applied between the anode and each cathode so that a potential between neighboring electrodes may be 3.8 volts, respectively. An electrolysis run is continued for 24 hours by causing circulation of bath and by occasionally supplying the bath material to making up for consumption so that the bath surface exhibits a substantially regular level. As a result 550 Kg of magnesium metal and 1650 Kg of chlorine gas are recovered. The parameters employed are: bath temperature 700° C., current supplied for electrolysis 8000 Amperes, current density 0.5 deciamperes/sq. cm, current efficiency 87%, and power consumption 9967 KWH/t-Mg.

Next, in the arrangement described above an elongated alumina block 30 cm high is inserted between the platform and each of the anode, cathodes and intermediate electrodes across the electrolysis chamber. When parameters identical to the above run are used as well as the bath composition, an improvement has been achieved in current efficiency up to about 90% and in power consumption down to 9634 KWH/t Mg. To this arrangement a strip of alumina of 5 cm (thickness)×20 cm (height)×1.2 m (width) is added atop each intermediate electrode with the upper end slightly above the bath surface level across the electrolysis chamber. The results with the same bath composition and at identical electrolysis parameters are: current efficiency around 92%, and power consumption 9425 KWH/t-Mg.

In a case where a channel means is employed atop the cathodes and intermediate electrodes, the obtained results are substantially identical to the last case.

The results obtained with some of apparatus construction according to the invention are sure to exhibit a substantially improved achievements over prior art in which the intermediate electrodes are not employed and which consumes power as much as 14000 to 18000/t-Mg.

As may be obvious from the description given above, the present invention:

1. permits a much simplified construction of electrolysis chamber, because only one anode and one or two cathodes needs to be externally wired for power supply, independently from the multiplicity of electrodes contained in the chamber for increased production. In cases where a channel means is employed magnesium and chlorine products are recovered at an improved separation, so that any partition can be eliminated which has been indispensable to conventional construction between the anode and cathode. Thus an apparatus of simplified compact design is obtainable;

2. permits reduced power consumption for reasons:

a. that number of electrodes externally wired has been decreased by far which cause voltage drop, resulting in an improved power efficiency, in comparison with cases where the same number of electrodes are respectively wired in parallel as conventional;

b. that heat loss can form only through one anode and one or two cathode (s) which have an end outside the chamber for electrical wiring, thus resulting in a substantially decreased heat loss;

c. that by far less bus-bar (wiring) is used per apparatus than in conventional cases, so that number of joints to the electrodes, which cause a substantial voltage drop, has been much decreased accordingly; and d. that only one electrode of graphite is necessary which material exhibits an electrical resistivity about 100 times as great as usual metal, so that power loss in heat and/or voltage drop caused by such resistivity has been minimized; and 3. permits production of magnesium metal and chlorine gas at the anode and cathode as well as the intermediate electrodes, giving a substantially raised productivity; and 4. A tight closure of the apparatus can be readily achieved because only two electrodes at most penetrate the chamber to cause difficulty in construction of sealed chamber. Thus advantages of sealed chamber can be readily obtained. They are; by preventing introduction of atmospheric oxygen into the chamber or leakage of chlorine gas to outside the chamber, consumption of graphite anode and sludge formation are effectively decreased; chlorine gas of higher purity is obtainable; and environmental pollution can be eliminated for an improved working ambience.

What I claim is:

1. In an apparatus for electrolytic production of magnesium metal from magnesium chloride which apparatus comprises:

(1) a closed electrolysis chamber which is capable of holding in fused state a bath material substantially containing magnesium chloride;

(2) at least one anode and cathode pair contained in said chamber substantially vertically with one end, respectively, outside the chamber for electrical connection;

(3) means for individually recovering the products of magnesium metal and chlorine gas; and (4) at least one externally unwired intermediate electrode arranged substantially parallel to and between each anode and cathode pair;

an improvement which comprises said anode, cathode and intermediate electrode each being mounted onto a raised top of a platform of an electrically non-conductive refractory material constructed.

2. An improvement as recited in claim 1, in which said electrodes are placed immediately on said top of the platform.

3. An improvement as recited in claim 1, in which an elongated block of an electrically non-conductive refractory material is provided as inserted between each electrode and the platform across the electrolysis chamber.

4. An improvement as recited in claim 1, which further comprises at least one additional electrically insulative piece being provided on an intermediate electrode.

5. An improvement as recited in claim 4, in which said additional piece is provided on at least one of the remaining edges about the major face of the intermediate electrodes.

6. An improvement as recited in claim 4, in which said additional piece is provided on at least one of the intermediate electrodes.

7. An improvement as recited in any of claims 4, 5 and 6, in which the anode has an adjacent block of an electrically non-conductive refractory material to cover at least an area of the anode up from a top level of intermediate electrodes to a bath surface level.

8. In an apparatus for electrolytic production of magnesium metal from magnesium chloride which apparatus comprises:

(1) a closed electrolysis chamber which is capable of holding in fused state a bath material substantially containing magnesium chloride;

(2) at least one anode and cathode pair contained in said chamber substantially vertically with one end, respectively, outside the chamber for electrical connection;

(3) means for individually recovering the products of magnesium metal and chlorine gas; and (4) at least one externally unwired intermediate electrode arranged substantially parallel to and between each anode and cathode pair;

an improvement in which a channel means is provided for products of chlorine gas and magnesium metal to lead towards respective outlets at an upper portion of electrodes, said channel means substantially having a configuration of open-bottom and closed-top with a ceiling thereof ascending towards one end, said upper end being below the bath surface level.

9. An improvement as recited in claim 8, in which said channel means substantially consists of a separate body of an electrically insulative material and is placed with the opening above the cathode(s) and each cathodic side of intermediate electrodes.

10. An improvement as recited in claim 8, in which said channel means substantially consists a groove formed on the cathode(s) and each cathodic side of intermediate electrodes.

11. An improvement as recited in claim 8, in which said channel means substantially consists of a separate body of an electrically insulative material and is placed with the opening above each anodic side of intermediate electrodes and attached to the anode with an upper portion above the bath surface level.

12. In an apparatus for electrolytic production of magnesium metal from magnesium chloride which apparatus comprises:

(1) a closed electrolysis chamber which is capable of holding in fused state a bath material substantially containing magnesium chloride;

(2) at least one anode and cathode pair contained in said chamber substantially vertically with one end, respectively, outside the chamber for electrical connection;

(3) means for individually recovering the products of magnesium metal and chlorine gas; and (4) at least one externally unwired intermediate electrode arranged substantially parallel to and between each anode and cathode pair;

an improvement in which said anode substantially consists of graphite and a metallic material, the latter forming an outside of the anode at an upper-end portion to be electrically connected and an inside thereof at a lower portion.

13. An improvement as recited in claim 12, in which said metallic material is selected from a group of nickel metal and nickel based alloys.

14. In an apparatus for electrolytic production of magnesium metal from magnesium chloride which apparatus comprises:

(1) a closed electrolysis chamber which is capable of holding in fused state a bath material substantially containing magnesium chloride;

(2) at least one anode and cathode pair contained in said chamber substantially vertically with one end, respectively, outside the chamber for electrical connection;

(3) means for individually recovering the products of magnesium metal and chlorine gas; and (4) at least one externally unwired intermediate electrode arranged substantially parallel to and between each anode and cathode pair;

an improvement in which the electrolysis chamber is provided with an external cooling passage for electrolyte bath, which communicates the bath surface level of said chamber with a bottom portion thereof and which is provided with a means for cooling the bath while the latter passes therein.

15. An improvement as recited in claim 14, in which said cooling means essentially consists of a wall of a decreased thickness onto which cold air is allowed to contact on the outside thereof.

16. An improvement as recited in claim 14, in which said passage is provided therein with a piping through which cold air is introduced.

* * * * *